US010716988B2

(12) United States Patent
Slechta

(10) Patent No.: US 10,716,988 B2
(45) Date of Patent: Jul. 21, 2020

(54) PUNCHING BAG SYSTEM

(71) Applicant: Steven Slechta, Lakewood, OH (US)

(72) Inventor: Steven Slechta, Lakewood, OH (US)

( * ) Notice: Subject to any disclaimer, the term of this patent is extended or adjusted under 35 U.S.C. 154(b) by 0 days.

(21) Appl. No.: 16/364,253

(22) Filed: Mar. 26, 2019

(65) Prior Publication Data

US 2019/0217176 A1 Jul. 18, 2019

Related U.S. Application Data

(63) Continuation-in-part of application No. 15/454,691, filed on Mar. 9, 2017, now abandoned.

(51) Int. Cl.
*A63B 69/20* (2006.01)

(52) U.S. Cl.
CPC ..... *A63B 69/201* (2013.01); *A63B 69/20* (2013.01); *A63B 69/205* (2013.01); *A63B 2209/10* (2013.01)

(58) Field of Classification Search
CPC ..... A63B 69/20; A63B 69/203; A63B 69/208; A63B 69/24; A63B 69/201; A63B 69/205
See application file for complete search history.

(56) References Cited

U.S. PATENT DOCUMENTS

| | | | | |
|---|---|---|---|---|
| 4,593,901 | A * | 6/1986 | Moore | A63B 69/0079 473/575 |
| 5,286,241 | A * | 2/1994 | Petrakis | A63B 69/205 482/83 |
| 5,389,057 | A * | 2/1995 | Zagata, Jr. | A63B 69/004 482/83 |
| D385,605 | S * | 10/1997 | Ferrara | D21/787 |
| D426,585 | S * | 6/2000 | Manniso | D21/301 |
| 6,872,171 | B2 | 3/2005 | Haselrig | |
| D584,785 | S | 1/2009 | McDonald | |
| 7,641,601 | B2 | 1/2010 | Jaet | |
| 8,523,712 | B2 * | 9/2013 | Safran | A63B 69/004 473/422 |
| 8,814,728 | B2 | 8/2014 | Safran | |
| 8,876,671 | B1 | 11/2014 | Hurtato, Jr. | |
| 9,211,465 | B1 | 12/2015 | Lambrinos | |
| 2008/0032872 | A1 | 2/2008 | Nappier | |
| 2009/0264264 | A1 | 10/2009 | Reen | |
| 2014/0080681 | A1 | 3/2014 | Knight | |
| 2016/0206943 | A1 | 7/2016 | Campbell et al. | |

* cited by examiner

*Primary Examiner* — Megan Anderson
(74) *Attorney, Agent, or Firm* — Dominic A. Frisina

(57) ABSTRACT

A strike training attachment for a heavy bag may include a ball member sized according to the diameter of a typical adult human fist. The ball member may be resilient. The strike training attachment includes a loop member disposed on an outer surface of the ball member. The loop member may be attachably co-operable with a hang-mounting member of a heavy bag.

5 Claims, 5 Drawing Sheets

PUNCHING BAG SYSTEM

I. CROSS-REFERENCE TO RELATED APPLICATIONS

The present application is a continuation-in-part of U.S. patent application Ser. No. 15/454,691 filed Mar. 9, 2017, entitled PUNCHING BAG SYSTEM, which is incorporated by reference in its entirety.

II. BACKGROUND OF THE INVENTION

A. Field of Invention

The invention generally relates, but is not necessarily limited, to the field of punching devices, particularly additional targets to be combined with a punching bag.

B. Description of the Related Art

Punching bags are used for fitness training, particularly for fight training such as boxing, martial arts, etc. Punching a bag offers resistance training which improves development of the muscles in the upper body, increasing punch strength. Punching a bag also helps improve movement, coordination and fighting techniques, as it can simulate blows delivered to an opponent. Punching bag types include a "speed bag," which can help train for delivering blows to a head, and a "heavy bag," which can simulate punches to the torso.

In traditional punching bag training, punches tend to be delivered to the same area(s) on the bag. This can result in a lack of variety of muscle movements, which diminishes the value of the training and can also result in a monotonous workout. Moreover, traditional heavy bags are cylindrical in shape while speed bags have a "tear drop" shape. Such shapes therefore do not properly simulate the shape of the human body, and cannot offer realistic fight training.

One solution to these problems is to fashion a special type of heavy bag that more closely approximates actual fighting, with a variety of targets placed at various positions along the bag. This enables a variety of punching motions and directions which can provide a broader range of muscle development and coordination that can offer better preparation for fighting. However, such proprietary designs are complicated and cumbersome, requiring special construction considerations which can be expensive to manufacture.

Another solution to these problems is to provide target members that can be affixed or suspended to a heavy bag, which can be alternately struck during training. In one type of prior art design, a plurality of targets can be individually suspended by cords from the top of a heavy bag. Another type of target can be affixed around the circumference of a heavy bag, either as a single target, perhaps representing a face, or a plurality of targets encircling the bag. However, such targets also rely on proprietary designs that require special construction considerations that can be expensive to manufacture.

Some embodiments of the present invention may provide one or more benefits or advantages over the prior art.

III. SUMMARY OF THE INVENTION

Some embodiments may relate to a strike training attachment for a heavy bag, comprising a ball member sized according to the diameter of a typical adult human fist. The ball member may be resilient. The embodiment may include a loop member disposed on an outer surface of the ball member. The loop member may be attachably co-operable with a hang-mounting member of a heavy bag.

According to some embodiments the loop member is a closed loop sized to allow the ball member to pass through the loop.

Embodiments may optionally further comprise fastenably closable ends.

According to some embodiments the ends comprise matable fasteners selected from one or more of hook and loop, snaps, or buckles.

According to some embodiments the loop member defines cross sectional dimensions threadably co-operable with a link of a chain comprising the hang-mounting member of a heavy bag.

According to some embodiments the loop member defines a closed loop.

Embodiments may optionally further comprise an openable attachment loop retainably engageable simultaneously with the loop member and with the hang-mounting member of a heavy bag.

According to some embodiments the openable attachment loop defines cross sectional dimensions threadably co-operable with a link of a chain comprising the hang-mounting member of a heavy bag.

Other benefits and advantages will become apparent to those skilled in the art to which it pertains upon reading and understanding of the following detailed specification.

IV. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

V. DETAILED DESCRIPTION OF THE INVENTION

As used herein the terms "embodiment", "embodiments", "some embodiments", "other embodiments" and so on are not exclusive of one another.

Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Figure 1:
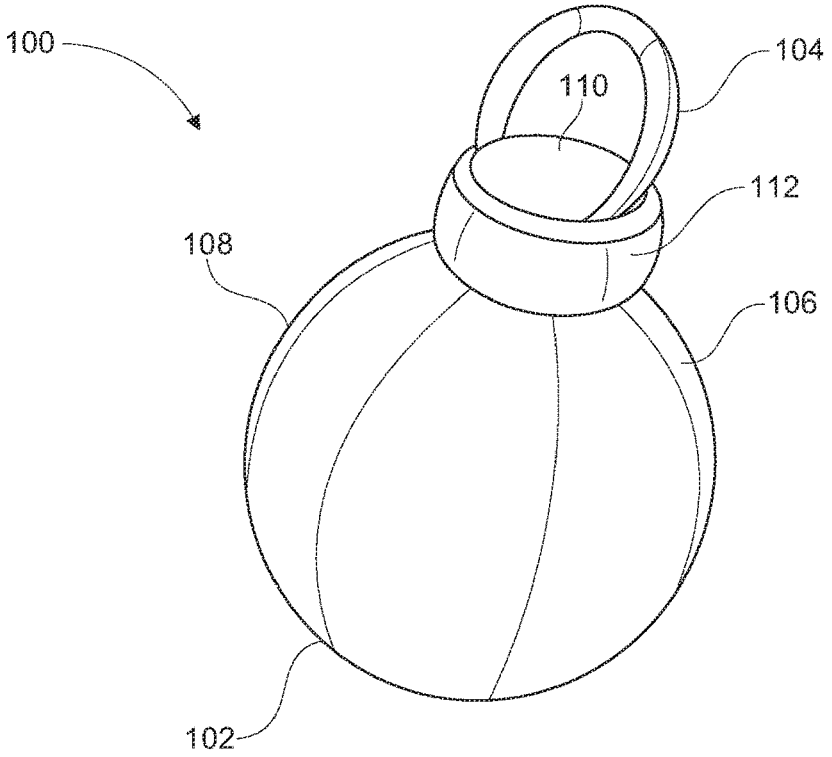
FIG. 1 is an elevational perspective view of an embodiment of a strike training attachment.

Referring now to the drawings wherein the showings are for purposes of illustrating embodiments of the invention only and not for purposes of limiting the same, FIG. 1 is an overall view of an embodiment 100 of a strike training attachment fully assembled and ready to be installed on a conventional heavy bag. The embodiment 100 includes a ball member 102 representing a strike target to be used in fight training. The ball member 102 may be sized according to the diameter of a typical adult human fist, e.g., approximately three to four inches measured from index knuckle to pinky knuckle. The ball member 102 is resilient, i.e., formed of a material having sufficient flexibility to deform and thereby absorb energy of a punch while yet possessing sufficient rigidity to offer strike resistance. A loop member 104 is disposed on an outer surface 106 of the ball member 102. The loop member 104 is attachably co-operable with a hang-mounting member of a heavy bag, as will be described in detail hereinbelow.

Figure 2:
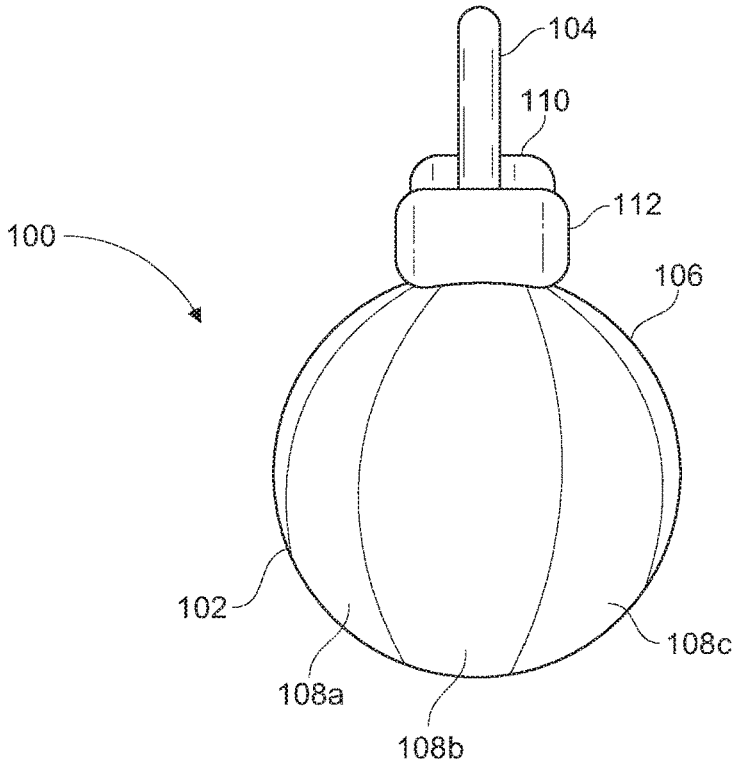
FIG. 2 is a side elevational view of an embodiment of the strike training attachment.

FIG. 1 and FIG. 2 illustrate the exterior construction of the ball member 102. The outer surface 106 may be generally spherical and can include a covering 108, which can be formed as a plurality of strips 108*a*, 108*b*, 108*c*, etc. The strips 108*a*, 108*b*, 108*c* may be laid over the outer surface 106 in a direction following an axis of symmetry. Optionally, the strips 108*a*, 108*b*, 108*c* may have a tapered width so as to be wide in a medial region and narrow at the ends, with adjoining edges in a generally abutting arrangement, resulting in a generally "barrel-shaped" configuration, so as to provide a uniform coverage over the outer surface 106. However, the strips 108*a*, 108*b*, 108*c* may be of uniform width and overlap in converging areas on the outer surface 106. Alternatively, the strips 108*a*, 108*b*, 108*c* may be laid over the outer surface 106 in more or less random directions, overlapping accordingly, so that the entire outer surface 106 is covered. The strips 108*a*, 108*b*, 108*c* may be formed of a rubberized cloth-impregnated material, with adhesive formed on an underside of the strips 108*a*, 108*b*, 108*c* in contact with the outer surface 106.

With continuing reference to FIG. 1 and FIG. 2, the embodiment may include a securing member 110 to provide additional mechanical strength for retaining the loop member 104 in contact with the ball member 102. The securing member 110 may be a strip of similar shape and material to the strips 108*a*, 108*b*, 108*c*. An end of the securing member 110 may be inserted through the middle of the loop member 104 so that the two ends of the securing member 110 adhere to the outer surface 106 of the ball member 102, secured underneath the covering 108. Alternatively, the securing member 110 may be an extended length portion of one of the strips 108*a*, 108*b*, 108*c*, extended through the middle of the loop member 104 and applied to the outer surface 106 of the ball member 102. Optionally, more than one securing member 110 can be employed on generally opposite sides of the ball member 102 and extending through the loop member 104 from opposite directions. A reinforcing strip 112 is wrapped around the outside of the securing member(s) 110 in a direction generally perpendicular to the direction of the strips 108*a*, 108*b*, 108*c*, in order to provide reinforcement of the securing member(s) 110 and thereby provide further mechanical strength of the loop member 104.

Figure 3:
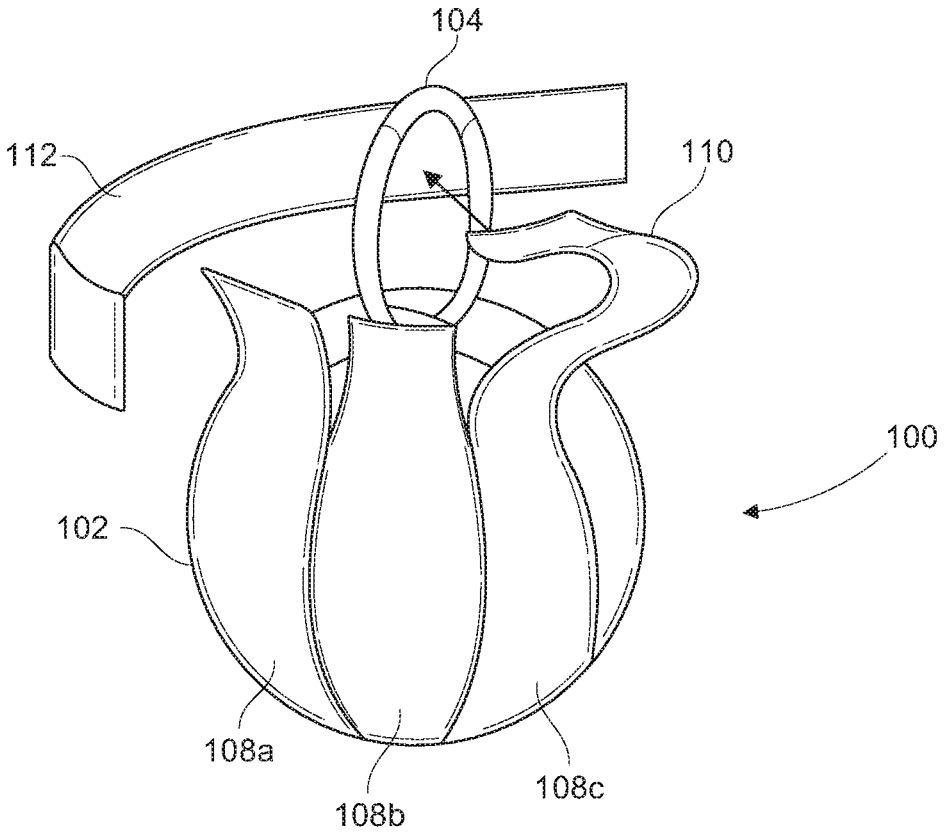
FIG. 3 is a partially exploded view of the exterior surface covering of the strike training attachment.

FIG. 3 is a partially exploded view of an embodiment of the covering 108 of the strike training attachment 100. The strips 108*a*, 108*b*, 108*c* are shown with their ends peeled back from a portion of the ball member 102 in engagement with the loop member 104. This embodiment depicts the aforementioned example in which the securing member 110 is formed as an extended length portion of one of the strips 108*a*, 108*b*, 108*c*, extended through the middle of the loop member 104 to be applied to the outer surface 106 of the ball member 102. The reinforcing strip 112 is shown in an unwrapped configuration, so that, upon application of the securing member 110 to the outer surface 106, the reinforcing strip 112 may be wrapped around the outside of the securing member 110 and encircling the loop member 104 in order to provide mechanical reinforcement.

In another embodiment, the covering 108 may be formed of a unitary construction, such as a solid rubber body which may be formed from a dipping process in which an interior of the ball member 102 is dipped in rubber so that the covering 108 is formed as an exterior rubber layer that covers over an end of the loop member 104. The covering 108 may be a plurality of rubber layers formed from a respective plurality of dipping processes, in which are permitted to cure between each clipping process.

Figure 4:
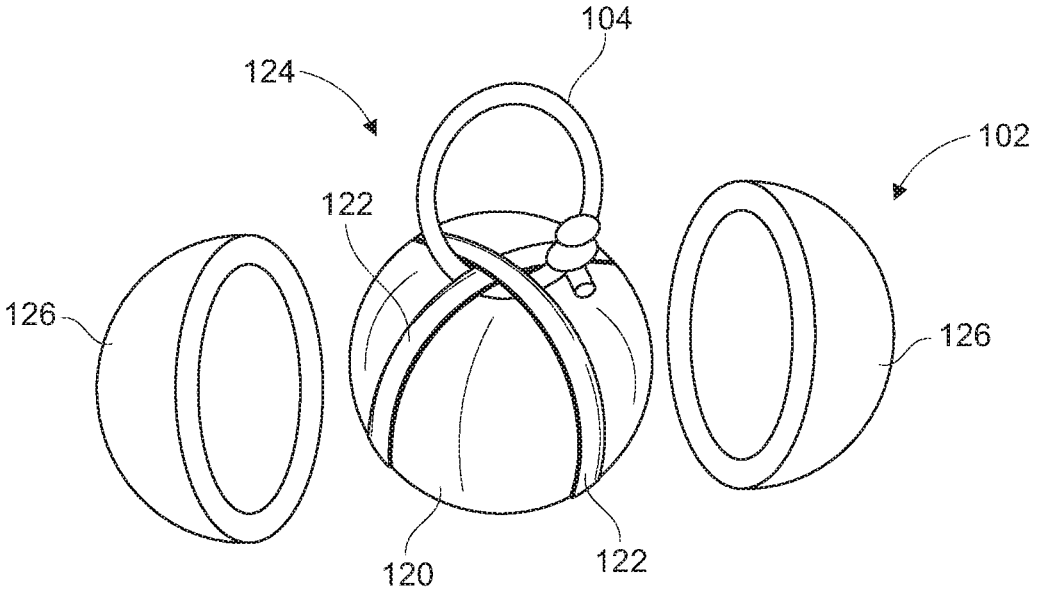
FIG. 4 is an exploded view of the interior construction of the strike training attachment.

FIG. 4 is an exploded view of an embodiment of the interior construction of the strike training attachment 100. In this view, the covering 108 is not shown. The ball member 102 includes an interior sphere 120 which may be a resilient ball, formed of rubber or similar resilient construction. The interior sphere 120 is encircled with a pair of straps 122 that securely engage the interior sphere 120. The straps 122 may be formed of nylon and may have an engagement structure for receiving an end of the strap 122 to enable the strap 122 to be selectively tightened. As depicted, the straps 122 can be affixed in a perpendicularly intersecting fashion. However, the straps 122 can be arranged in any manner, and in any number, that would securely engage the interior sphere 120. For example, three straps 122 may also be employed, or even a single strap 122, as long as secure engagement of the interior sphere 120 is effected.

With continuing reference to FIG. 4, the loop member 104 is inserted underneath the straps 122, at an intersection of the two straps 122, to be retained securely in between the straps 122 and the interior sphere 120. The loop member 104 is formed of an elastic material that enables stretching. For example, the loop member 104 could be formed of "bungee cord" material, in accordance with a common, commercially-available product, formed of elastic strands encircled in a fabric sheath. As depicted, the loop member 104 is formed of a length of elastic material in which the ends are knotted, so as to close up into a loop. However, the ends can be joined together in a variety of different ways, as will be explained in greater detail hereinbelow. The interior sphere 120 with straps 122 and loop member 104, affixed together as described hereinabove into an interior sphere assembly 124, may then be encased in an exterior sphere 126. The exterior sphere 126 may be hollow with a spherical void having a sufficient diameter sized to receive the interior sphere assembly 124. The exterior sphere 126 may be formed of a flexible, porous foam material, having greater resilience than the interior sphere 120. As depicted, the exterior sphere 126 may be formed of two mating hemispheres that are glued together at mating, planar, bisecting surfaces. Alternatively, the exterior sphere 126 may be formed as a single sphere but having an opening sufficiently large and flexible to allow the interior sphere assembly 124 to be admitted therein, with the loop member 104 extending therefrom. The exterior sphere 126 may be encased by the covering 108 in accordance with the descriptions of the covering 108 contained hereinabove.

Figure 5:
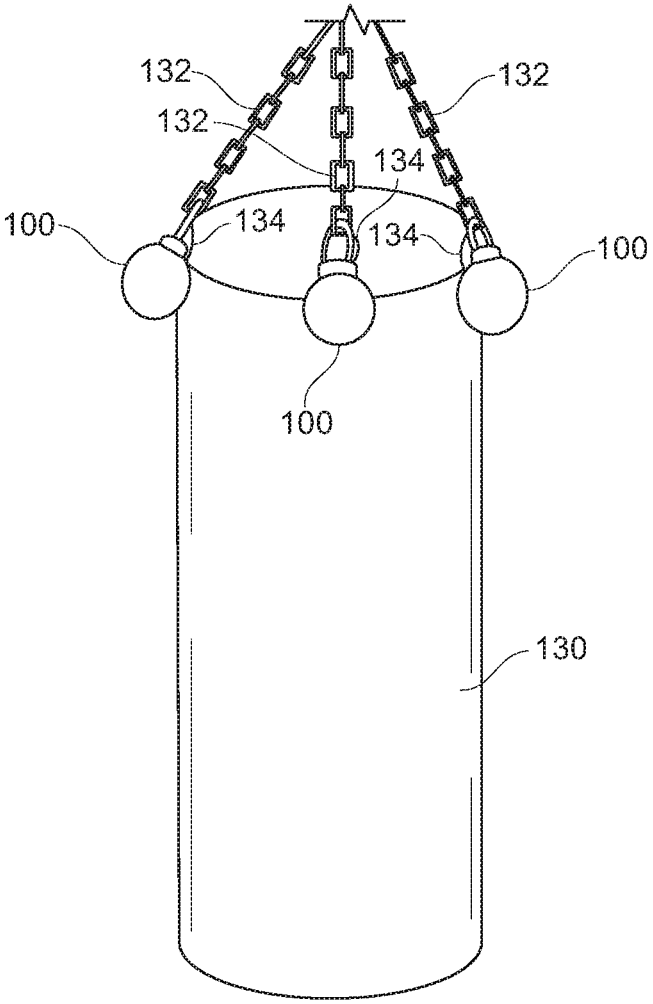
FIG. 5 is a side elevational view of an embodiment of a plurality of strike training attachments fully installed on a common heavy bag.

FIG. 5 illustrates an embodiment in which a plurality of strike training attachments 100 are fully installed on a common heavy bag 130. As shown, the heavy bag 130 is supported by a plurality of hang-mounting members 132, each connected on one end to a ceiling mount (not shown) and with another end affixed to the heavy bag 130 by a respective plurality of mounting structures 134. The hang-mounting members 132 are conventionally steel chains, or in some cases fabric straps, e.g. made from nylon webbing. However, it is to be appreciated that any suitable structures could be alternatively employed such as ropes, cables, or the like. A strike training attachment 100 can be hung from each hang-mounting member 132, or from one or more selected hang-mounting members 132. In one embodiment as depicted in FIG. 5, the loop member 104 of each strike training attachment 100 can be slipped over an end of a respective hang-mounting member 132, so that the loop member 104 can substantially surround the hang-mounting member 132, and to be draped along a top surface of the heavy bag 130.

Figure 6:
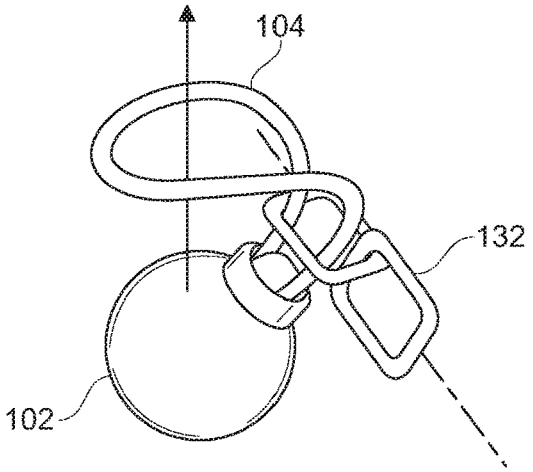
FIG. 6 is an elevated perspective view depicting an embodiment engaging the loop member of the strike training attachment to a heavy bag.
Figure 7:
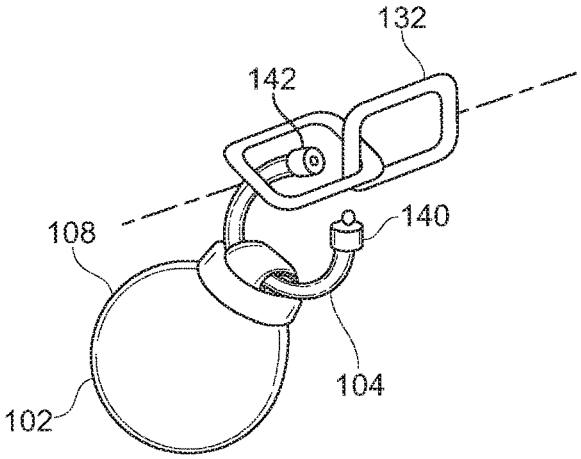
FIG. 7 is an elevated perspective view depicting another embodiment of engaging the loop member of the strike training attachment to a heavy bag.
Figure 8:
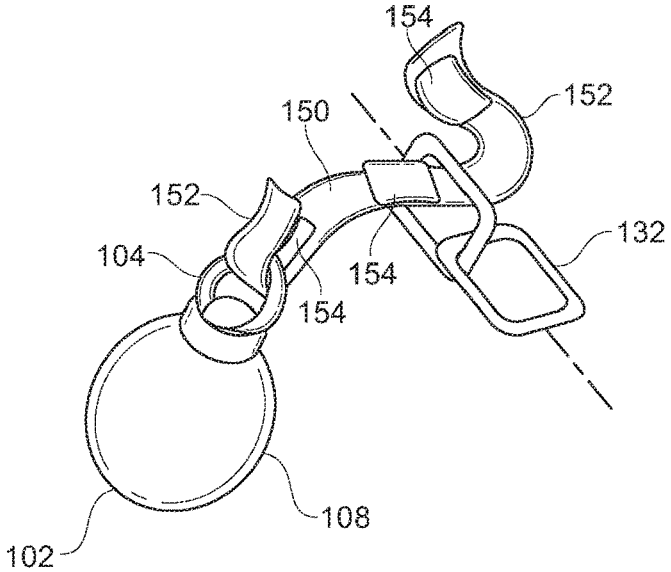
FIG. 8 is an elevated perspective view depicting yet another embodiment of engaging the loop member of the strike training attachment to a heavy bag.

FIG. 6, FIG. 7, and FIG. 8 depict various embodiments of engaging the loop member 104 of the strike training attachment 100 to a heavy bag 130. Each of FIGS. 6-8 illustrate non-limiting examples of the loop member 104 being attachably co-operable with a hang mounting member 132 of a heavy bag 130. FIG. 6 depicts an embodiment in which the loop member 104 is a closed loop with the ends knotted or otherwise conjoined and secured underneath the covering 108, in the manner disclosed in previously-described embodiments hereinabove. A loop member 104 may be fabricated as a continuous loop thereby obviating the need to knot or otherwise conjoin ends. The loop member 104 may be fashioned to be an extra long closed loop sized to allow the ball member 102 to pass through the loop. In this manner, the strike training attachment 100 can be attached to the hang-mount member 132 as a "lark's head" or "cow hitch" knot (commonly used to attach luggage tags and lanyards). In the latter configuration, the end of the loop member 104 is slid through an open link in the chain (or alternatively, encircling the exterior of the hang-mount member 132), and the ball member 102 is inserted through the opening of the loop member 104, whereupon the loop member 104 is tightened over the hang-mount member 132. This embodiment is useful for securing the strike training attachment 100 to the heavy bag 130 without removing the respective hang-mount member 132 from either the mounting structure 134 or the ceiling mount.

FIG. 7 illustrates an embodiment in which the loop member 104 is formed with fastenably closable ends. In this embodiment, the ends are not necessarily knotted or otherwise conjoined underneath the covering 108 but are open outside the internal structure of the strike training member 100. In order to secure the strike training attachment 100 to the heavy bag, the ends are formed to include matable fasteners 140, 142. The matable fasteners 140, 142 may be selected from one or more of hook and loop, snaps, or buckles. As depicted in FIG. 7, the matable fasteners may be snaps having a male end 140 and a female end 142. Once the matable fasteners 140, 142 are engaged, the loop member 104 may encircle the exterior of the hang-mount member 132. In such an embodiment, the cross-sectional dimensions of the loop member 104 can be of any selected size or diameter. In another embodiment, the loop member 104 defines cross sectional dimensions that are threadably co-operable with a link of a chain comprising the hang-mounting member 132 of the heavy bag 130. In other words, in such an embodiment, the selected cross-sectional size or diameter of the loop member 104 is sufficiently small enough to be threaded through a link of the chain of the hang-mounting member 132.

FIG. 8 illustrates an embodiment in which the loop member 104 defines a closed loop. An intermediary structure is used to removably connect the strike training attachment 100 to the hang-mounting member 132. As with the embodiment of FIG. 6 described hereinabove, the embodiment shown in FIG. 8 is also useful for securing the strike training attachment 100 to the heavy bag 130 without removing the respective hang-mount member 132 from either the mounting structure 134 or the ceiling mount. The intermediary structure may be an openable attachment loop in the form of a belt or strap 150 retainably engageable simultaneously with the loop member 104 and with the hang-mounting member 132 of the heavy bag 130. The belt 150 may have ends 152 that fold back onto themselves to provide securement. As depicted, the folded portions of the ends 152 include hook-and-loop fastener pads 154, affixed in a generally facing relationship to each other. One end 152 is inserted through the loop member 104 while the other end 152 may essentially surround the hang-mount member 132. The pads 154 on each end 152 may be selectively brought into mating contact in order to securely engage the belt 150 at both the loop member 104 and the hang-mount member 132. As depicted in FIG. 8, the openable attachment loop or belt 150 defines cross sectional dimensions threadably co-operable with a link of a chain comprising the hang-mounting member 132 of the heavy bag 130. In other words, in such an embodiment, the width of the belt 152 is sufficiently narrow to be threaded through a link of the chain of the hang-mounting member 132.

Figure 9:
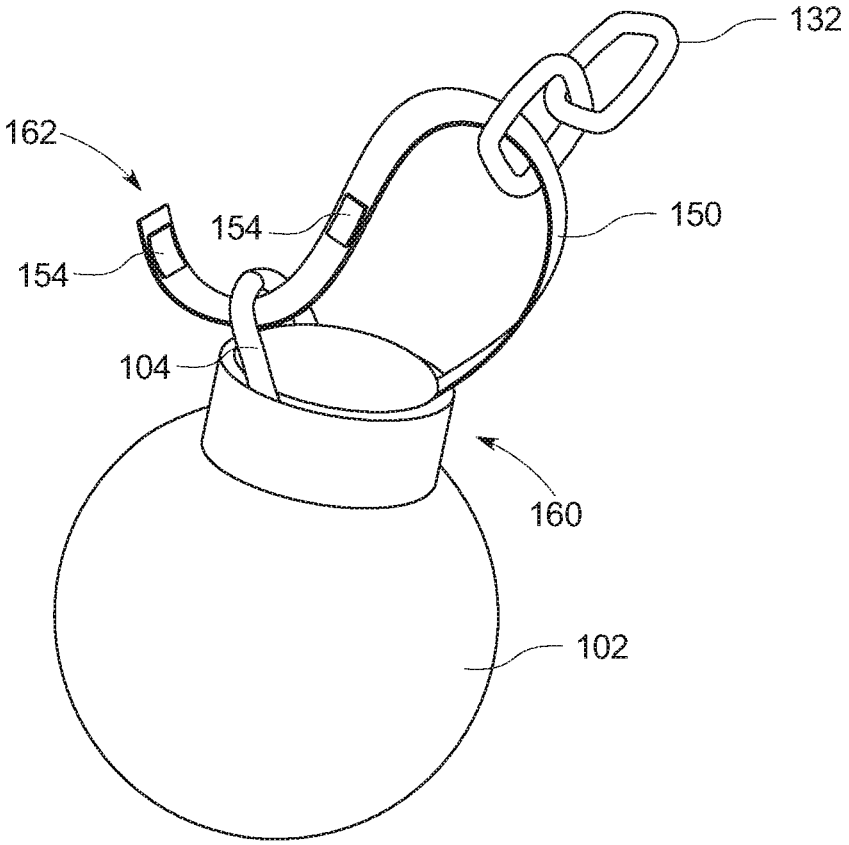
FIG. 9 is a perspective view of an embodiment showing an attachment loop with hook and loop fastener pads engaging a loop member.

FIG. 9 illustrates a variation of the embodiment shown in FIG. 8, wherein the openable attachment loop, again in the form of a belt or strap 150, is permanently affixed to the ball member 102 at a first end 160 according to any known means of attachment such as, without limitation, sewing, bonding, or even securing to a strap 122 of the interior sphere 120. A second end 162 of the strap 150 is equipped with hook and loop fasteners 154. Thus the second end may be threaded through both the hang-mounting member 132 and the loop member 104 and folded back over itself, as shown, to close the attachment loop 150 and retainably engage the loop member 104. The person having ordinary skill in the art will readily appreciate that the fasteners 154 are not be limited to hook and loop fasteners, but rather may be any known fastener selectable as a matter of design choice. For instance, snaps, buttons, and buckles are all suitable choices.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

Having thus described the invention, it is now claimed:

1. A strike training attachment for a heavy bag, comprising:

a ball member sized according to the diameter of a typical adult human fist, wherein the ball member is resilient;

a loop member disposed on a surface of the ball member, the loop member being attachably co-operable with a hang-mounting member of a heavy bag, wherein the loop member defines a closed loop; wherein the ball member comprises a resilient interior sphere encased in a resilient exterior sphere; wherein the loop member is affixed to the resilient interior sphere with one or more straps; and further comprising a covering encasing the resilient exterior sphere.

2. The strike training attachment of claim 1, wherein the covering comprises a plurality of strips of rubberized cloth-impregnated material having adhesive formed on an underside of the plurality of strips.

3. The strike training attachment of claim 2, further comprising a securing member strip of rubberized cloth-impregnated material having adhesive formed on an underside of the securing member strip, wherein the securing member strip passes through the loop member and adheres to the ball member and/or the covering.

4. The strike training attachment of claim 3, further comprising a reinforcing member, wherein the reinforcing member is wrapped around the outside of the securing member strip and encircles the loop member.

5. The strike training attachment of claim 1, wherein the covering comprises a unitary rubber body.

* * * * *